US007015461B2

(12) United States Patent
Shiokawa et al.

(10) Patent No.: US 7,015,461 B2
(45) Date of Patent: Mar. 21, 2006

(54) METHOD AND APPARATUS FOR ION ATTACHMENT MASS SPECTROMETRY

(75) Inventors: Yoshiro Shiokawa, Hachioji (JP); Megumi Nakamura, Fuchu (JP); Tohru Sasaki, Fuchu (JP); Toshihiro Fujii, Hamura (JP)

(73) Assignee: Anelva Corporation, Tokyo (JP)

( * ) Notice: Subject to any disclaimer, the term of this patent is extended or adjusted under 35 U.S.C. 154(b) by 0 days.

(21) Appl. No.: 10/024,243

(22) Filed: Dec. 21, 2001

(65) Prior Publication Data

US 2002/0084408 A1 Jul. 4, 2002

(30) Foreign Application Priority Data

Dec. 28, 2000 (JP) ..... 2000-401483

(51) Int. Cl.
*H01J 49/00* (2006.01)

(52) U.S. Cl. ..... 250/281; 250/288
(58) Field of Classification Search ..... 250/281
See application file for complete search history.

(56) References Cited

U.S. PATENT DOCUMENTS 4,948,962 A * 8/1990 Mitsui et al. ..... 250/288
5,194,739 A * 3/1993 Sato et al. ..... 250/423 R
6,008,490 A * 12/1999 Kato ..... 250/288
6,326,616 B1 * 12/2001 Andrien et al. ..... 250/288
6,566,652 B1 * 5/2003 Kato ..... 250/288
6,744,041 B1 * 6/2004 Sheehan et al. ..... 250/283

OTHER PUBLICATIONS

R. V. Hodges et al.. "Application of Alkali Ions in Chemical Ionization Mass Spectrometry", *Analytic Chemistry*, vol. 48, No. 6, pp. 825-829. (1976).
D. Bombick et al., "Potassium Ion Chemical Ionization and Other Uses of an Alkali Thermionic Emitter in Mass Spectrometry", *Analytical Chemistry*, vol. 56, No. 3, pp. 396-402, (1984).
Toshihiro Fujii et al., "Chemical Ionization Mass Spectrometry with Lithium Ion Attachment to the Molecule", *Analytical Chemistry*, vol. 61, No. 9, pp. 1026-1029, (1989).
Toshihiro Fujii. "A Novel Method for Detection of Radical Species in the Gas Phase: Usage of L i Ion Attachment to Chemical Species", *Chemical Physics Letters*, vol. 191, No. 1.2, pp. 162-168, (1992).
Japanese Patent Abstracts of JP-A-06-011485.

* cited by examiner

*Primary Examiner*—John R. Lee
*Assistant Examiner*—Phillip A Johnston
(74) *Attorney, Agent, or Firm*—Oliff & Berridge, PLC

(57) ABSTRACT

An apparatus for ion attachment mass spectrometry provided with an ion emitter for emitting positively charged metal ions, an ionization chamber for causing attachment of the metal ions to a gas to be detected, a third component gas introduction mechanism for introducing a third component gas into the ionization chamber, and a mass spectrometer for mass separation and detection of the detected gas with the metal ions attached. The third component gas introduction mechanism is provided with three types of third component gases and selectively introduces one type of third component gas from the three types of third component gases. Due to this, the occurrence of interference peaks due to macromers of third component gases with each other, macromers of third component gases and high concentration ingredients, etc. is prevented and accurate mass analysis made possible.

10 Claims, 9 Drawing Sheets

METHOD AND APPARATUS FOR ION ATTACHMENT MASS SPECTROMETRY

BACKGROUND OF THE INVENTION

1. Field of the Invention

The present invention relates to a method and apparatus for ion attachment mass spectrometry, and more particularly relates to a method and apparatus for ion attachment mass spectrometry suitable for measuring the ingredients and concentration of, for example, a low concentration detected gas without causing dissociation.

2. Description of the Related Art

An ion attachment mass spectrometry apparatus has the advantage of enabling quantitative analysis of a detected gas without causing dissociation. In the past, some ion attachment mass spectrometry apparatuses have been reported in Hodge, *Analytical Chemistry*, vol. 48, no. 6, p. 825 (1976); Bombick, *Analytical Chemistry*, vol. 56, no. 3, p. 396 (1984); and Fujii et al., *Analytical Chemistry*, vol. 1, no. 9, p. 1026 (1989), *Chemical Physics Letters*, vol. 191, no. 1.2, p. 162 (1992), and Japanese Unexamined Patent Publication (Kokai) No. 6-11485.

FIG. 9 schematically shows an example of the basic configuration of a conventional ion attachment mass spectrometry apparatus. As shown in FIG. 9, an apparatus vessel 10 is formed by an ionization chamber 11, a differential evacuation chamber 12, and a mass spectrometry chamber 13 connected in the cascade structure. The differential evacuation chamber 12 and mass spectrometry chamber 13 are respectively provided with a differential evacuation chamber vacuum pump 14 and mass spectrometry chamber vacuum pump 15. A first aperture 16 is arranged between the ionization chamber 11 and differential evacuation chamber 12, while a second aperture 17 is arranged between the differential evacuation chamber 12 and mass spectrometry chamber 13. The ionization chamber 11 is provided with an emission mechanism 20 comprised of an ion emitter 18 and a repeller 19. Further, the emission mechanism 20 is provided with an emission mechanism control power source 21. The ionization chamber 11 has a sample gas introduction mechanism 22 and a third component gas introduction mechanism 23, which are both connected to it. A sample gas and third component gas are introduced from these introduction mechanisms 22 and 23, respectively. In the sample gas introduction mechanism 22, reference numeral 24 designates a sample gas cylinder and 25 a valve. In the third component gas introduction mechanism 23, reference numeral 26 designates a third component gas cylinder and 27 a valve. The differential evacuation chamber 12 has a focusing lens 28 arranged in it. Reference numeral 29 designates a path of metal ions and a gas which should be detected and to which the metal ions are attached. The mass spectrometry chamber 13 is provided with a Q-pole type mass spectrometer 30. At the exit side of the Q-pole type mass spectrometer 30 is provided with an ion trap 31. The output section of the ion trap 31 is connected to a data processor 32.

The ion emitter 18 of the emission mechanism 20 is made of a material including an oxide of an alkali metal. The material comprising the ion emitter 18 is for example a mixture of an Li oxide, Si oxide, and Al oxide. When the ion emitter 18 placed on the axis of the apparatus vessel 10 is heated to about 600° C. by electric power supplied from the emission mechanism control power source 21, $Li^+$ or other positively charged metal ions are emitted into the space. These metal ions move toward an opening 16*a* of the first aperture 16 due to the electric field and flow of gas. During this moving period of time, the metal ions attach to the gas to be detected, which is introduced into the ionization chamber 11 as a sample gas by the sample gas introduction mechanism 22. In this way, the gas ionized by the attachment of metal ions is produced. For example, $H_2O$ becomes $H_2OLi^+$ of a mass number of the 18 amu (atomic mass units) of $H_2O$ plus the 7 amu of Li, that is, 25 amu. The positively charged ionized gas to be detected moves as it is and passes through the opening 16*a*. The above-mentioned path 29 shows the path of the metal ions and the gas with the metal ions attached.

When the metal ions attach to the molecules of the gas to be detected, they extremely gently attach to the locations of the charges biased on the gas molecules and almost no dissociation occurs. The smaller the bond energy, however, the easier the re-detachment of the $Li^+$. To prevent this, it is necessary to raise the pressure in the ionization chamber 11 to the value included in the range of 10–1000 Pa (usually 100 Pa) by the third component gas introduction mechanism 23 and use collision with the gas in order to absorb the excess energy. The third component gas which also can be defined as excess-energy absorbing gas, is one of various inert gases, such as $N_2$, which it relatively hard for the metal ions to attach to. The gas with the metal ions stably attached thereto passes through the differential evacuation chamber 12 where the focusing lens 28 is arranged. The gas subsequently enters the mass spectrometry chamber 13 where it is separated from the other gases so as to be detected in every mass through the Q-pole mass spectrometer 30.

When detecting a low concentration gas to be detected by use of the conventional ion attachment mass spectrometry apparatus shown in FIG. 9, an interference peak is sometimes caused and measurement of the signal about the detected gas becomes impossible due to concealment by the interference peak. There are four reasons for the appearance of the interference peak at this time, that is, (1) a macromer produced by third component gases, (2) a macromer produced by a third component gas and a high concentration ingredient, (3) surface ionization ions, (4) an isotope of metal ions.

Here, the "macromer" signifies a substance of two (dimer) or more gas molecules bonded together. For example, water is normally $H_2O$, but becomes $(H_2O)_2$ as a dimer. Nitrogen is normally $N_2$, but becomes $(N_2)_2$ as a dimer. In an ion attachment mass spectrometry method, there is the problem that even when there is actually no macromer, a slight amount of a macromer is finally produced in the process of ionization. For example, in the case of water, not only the usual $H_2OLi^+$, but also the dimer $(H_2O)_2Li^+$ appears, while in the case of nitrogen, not only the usual $N_2Li^+$, but also the dimer $(N_2)_2Li^+$ appears.

Further, the "surface ionization ions" signify ions produced by removing some atoms from the molecule of the gas when the gas comes in contact with a heated surface. In the ion attachment mass spectrometry method, there is the problem that after all the surface ionization ions are produced at the surface of the heated ion emitter 18 depending on the gas. For example, in the case of dimethylphthalate ($C_{10}H_{10}O_4$=194 amu), ions of 163 amu being less than the inherent mass number by exactly $OCH_3$ (31 amu) appear.

Further, the "isotope" signifies the same element with a different mass number. In the case of Li, most of them have the mass number of 7 amu, but an isotope with a mass number of 6 amu is also present in an amount of about 7.5%.

SUMMARY OF THE INVENTION

An object of the present invention is to provide a method and apparatus for ion attachment mass spectrometry capable of preventing the occurrence of the interference peak and carrying out accurate mass spectrometry when analyzing the mass of the gas to be detected by ionizing it using the ion attachment method.

The method and apparatus for ion attachment mass spectrometry according to the present invention are configured as follows so as to achieve the above-mentioned object.

A first method of ion attachment mass spectrometry is a method for attaching positively charged metal ions emitted from an ion emitter to a gas to be detected, which is introduced into an ionization chamber, in an atmosphere of a third component gas so as to ionize the gas by the metal ions, and then performing measurement of mass of the gas by mass spectrometry. In the method of the mass spectrometry measurement, a third component gas is selected from a plurality of third component gases prepared in advance.

A second method of ion attachment mass spectrometry is a method having the same ionization and measurement steps mentioned above, and further, in performing the measurement step, a plurality of measurements are performed respectively using different third component gases and interference peaks arising due to the third component gases are distinguished on the basis of the data obtained from the measurements.

A third method of ion attachment mass spectrometry is a method having the same ionization and measurement steps mentioned above, and further, in performing the measurement step, one ion emitter is selected from a plurality of ion emitters prepared in advance.

A fourth method of ion attachment mass spectrometry is a method having the same ionization and measurement steps mentioned above, and further the measurement step comprising steps of preparing a plurality of different ion emitters, performing measurement a plurality of times by different ion emitters, and distinguishing the interference peak arising due to the third component gas from the data.

A first apparatus for ion attachment mass spectrometry is provided with an ion emitter for emitting positively charged metal ions, an ionization chamber for attaching the metal ions to a gas to be detected, a third component gas introduction mechanism for preparing a plurality of types of third component gases in advance and introducing one type of third component gas selected from the plurality of types of third component gases into the ionization chamber, and a mass spectrometer for performing mass spectrometry to detect the gas to which the metal ions are attached.

A second apparatus for ion attachment mass spectrometry is provided with the ion emitter, the ionization chamber, the mass spectrometer, the third component gas introduction mechanism for introducing one type of third component gas selected from the plurality of types of third component gases prepared in advance into the ionization chamber, and a data processor for processing data given from the mass spectrometer in order to distinguish the interference peak arising due to the third component gas from a plurality of sets of measurement data based on a plurality of different types of third component gases.

A third apparatus for ion attachment mass spectrometry has the above-mentioned second apparatus configuration, and further has a plurality of types of ion emitters for emitting different types of positively charged metal ions, in which one of the plurality of types of ion emitters is selected for emission of the metal ions.

A fourth apparatus for ion attachment mass spectrometry has the above-mentioned second apparatus configuration, and is further configured so that a plurality of types of ion emitters for emitting different types of positively charged metal ions are prepared, one type of the ion emitters is selected for emission of the metal ions, and the data processor processes data given from the mass spectrometer for distinguishing the interference peak arising due to the ion emitter from a plurality of sets of measurement data based on the different ion emitters.

In the third and fourth apparatuses for ion attachment mass spectrometry, preferably, the plurality of types of ion emitters are arranged at positions offset from the axis.

In accordance with the method and apparatus for ion attachment mass spectrometry of the present invention, when $Li^+$ being normally low in generation of fragments is used as the primary ions and the interference peaks occur, in order to eliminate the interference peaks due to the macromers of the third component gases with each other and the macromers of the third component gases and the high concentration ingredients, one type of third component gas among a plurality of types of third component gases prepared in advance is selectively used depending on the type of the gas and the objective of the measurement. Further, in order to eliminate the interference peaks due to ionization ions at the surface of the ion emitter and isotopes of the metal ions, similarly, one type of ion emitter among the plurality of types of ion emitters prepared in advance is selectively used depending on the type of the gas and the objective of the measurement.

When using the ion attachment mass spectrometry apparatus to detect for example a low concentration gas, as explained above, the macromers of third component gases with each other, the macromers of third component gases and high concentration ingredients, the surface ionization ions, and the isotopes of metal ions normally cause the interference peaks in the measurement data obtained by the mass spectrometry and make measurement of the signal of the gas impossible due to concealment by the interference peaks. With the present invention, however, the occurrence of interference peaks is eliminated to make measurement possible. The means of eliminating the occurrence of the interference peaks, in view of the causes of them, are, first, to change the mass of the dimer ions appearing at the same positions as the detected ions to shift their position, second, to shift only the peaks position of the ionized gas by attachment of metal ions, or, third, to prevent the generation of isotope ions.

In accordance with the present invention, when detecting a low concentration gas for example by using the ion attachment mass spectrometry apparatus, the basic idea of the detection is to switch the third component gas or the ion emitter so as to change the mass of the dimer ions appearing at the same positions as the detected ions to shift their position, or shift only the peaks position of the ionized gas by attachment of metal ions, or prevent the generation of isotope ions, in order to prevent the generation of interference peaks and perform accurate mass spectrometry.

BRIEF DESCRIPTION OF THE DRAWINGS

The objects and features of the present invention will become clearer from the following description of the preferred embodiments given with reference to the attached drawings, in which.

DESCRIPTION OF THE PREFERRED EMBODIMENTS

Preferred embodiments of the present invention will be explained next with reference to the attached drawings.

Figure 1:
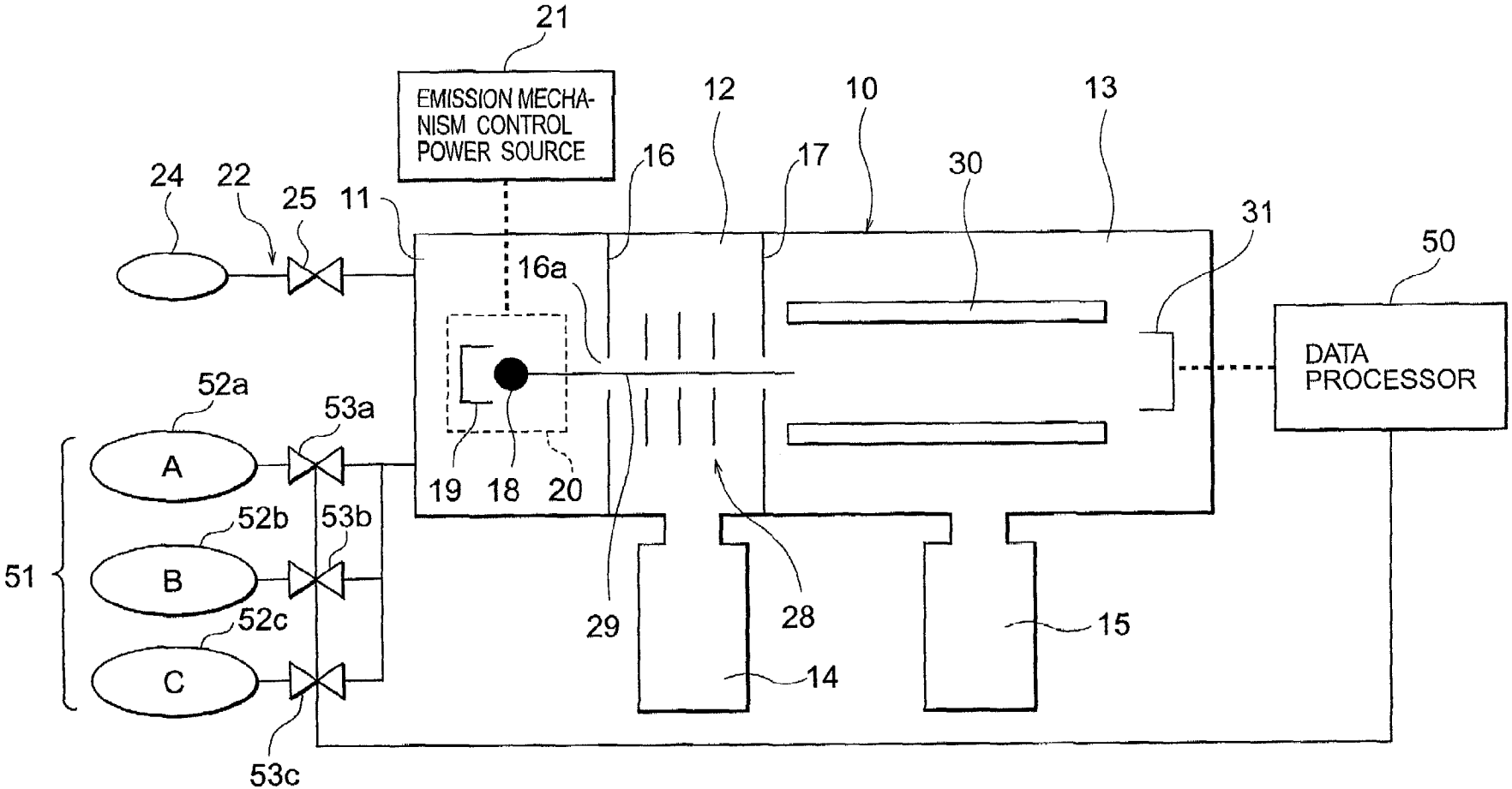
FIG. 1 is a view of the configuration of an embodiment of the ion attachment mass spectrometry apparatus according to the present invention.
Figure 9:
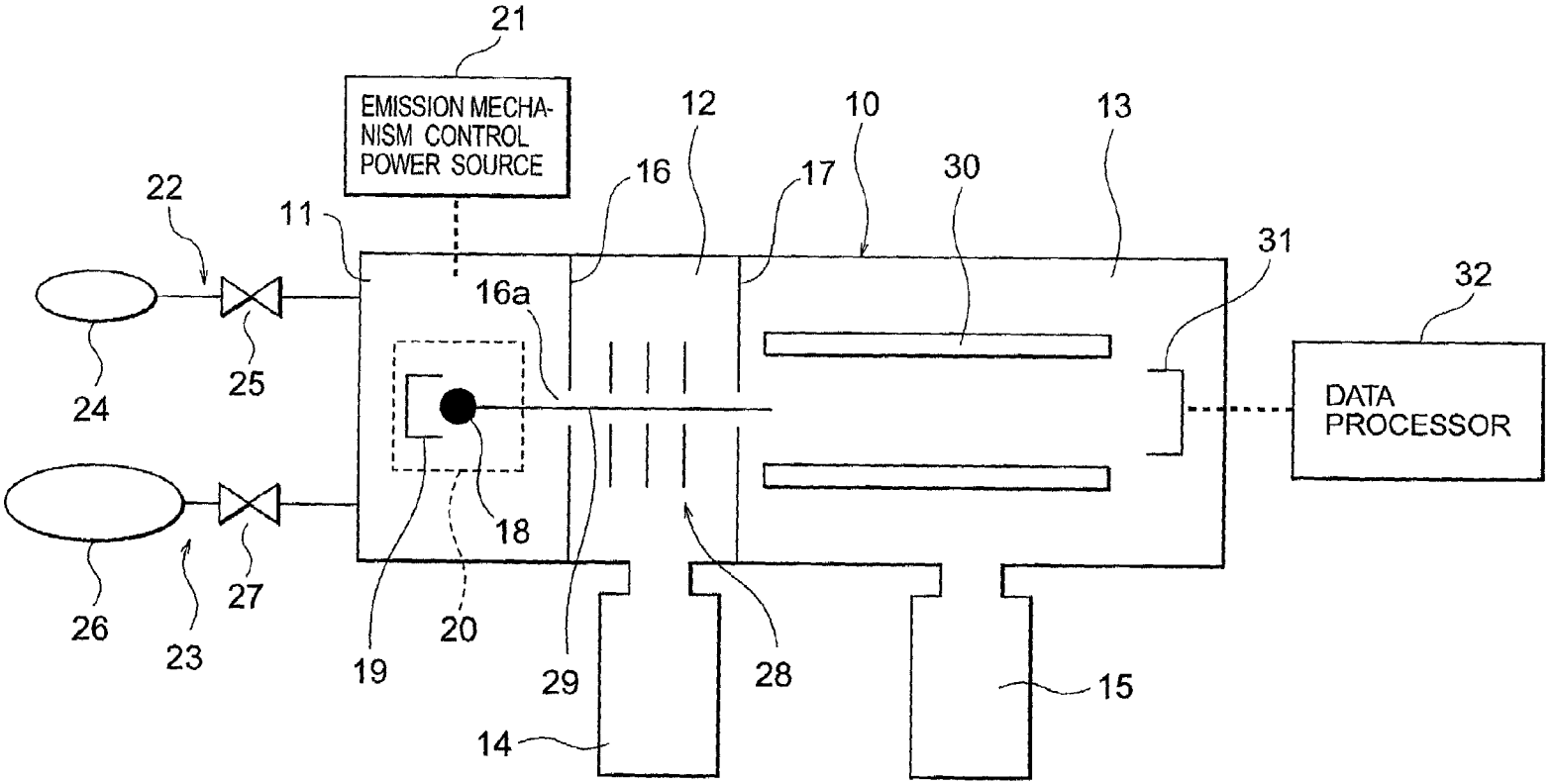
FIG. 9 is a view of the configuration of the conventional ion attachment mass spectrometer.

Embodiments of the method and apparatus for ion attachment mass spectrometry according to the present invention will be explained next with reference to FIG. 1. The basic configuration of the ion attachment mass spectrometry apparatus is the same as the basic configuration of the conventional apparatus explained with reference to FIG. 9. In FIG. 1, elements substantially the same as those explained in FIG. 9 are assigned the same reference numerals.

The basic configuration will be explained first. In the figure, an ionization chamber 11, a differential evacuation chamber 12, and a mass spectrometry chamber 13 are connected in cascade to form an apparatus vessel 10 as a whole. The differential evacuation chamber 12 and mass spectrometry chamber 13 are provided with vacuum pumps 14 and 15, respectively. A first aperture 16 is arranged between the ionization chamber 11 and differential evacuation chamber 12, while a second aperture 17 is arranged between the differential evacuation chamber 12 and mass spectrometry chamber 13. The ionization chamber 11 is provided with an emission mechanism 20 comprised of an ion emitter 18 and a repeller 19. Further, the emission mechanism 20 is provided with an emission mechanism control power source 21. The ionization chamber 11 has a sample gas introduction mechanism 22 connected to it. A sample gas is introduced from this. The sample gas introduction mechanism 22 includes a sample gas cylinder 24 and a valve 25. In this embodiment, the sample gas is a low concentration sample gas. The differential evacuation chamber 12 has a focusing lens 28 arranged in it. In the figure, the path 29 of the metal ions and the gas with the metal ions attached to it is shown. The mass spectrometry chamber 13 is provided with a Q-pole type mass spectrometer 30. The output section of the ion trap 31 is connected to a data processor 50. The data processor 50 has the function of processing the measurement data based on a detection signal given from the ion trap 31 and the function of controlling the valve opening and closing operation.

The ion emitter 18 of the emission mechanism 20, as explained in the section on the related art, is formed from a mixture of an Li oxide, Si oxide, and Al oxide, for example. When the ion emitter 18 placed on the axis of the apparatus vessel 10 is heated to about 600° C. by the electric power supplied from the emission mechanism control power source 21, $Li^+$ or other positively charged metal ions are emitted into the space. These metal ions move toward the opening 16*a* of the first aperture 16 due to the electric field and flow of gas. During this, the metal ions attach to the gas to be detected introduced into the ionization chamber 11 by the sample gas introduction mechanism 22. In this way, the gas ionized by the attachment of metal ions is produced. The rest of the basic configuration and action are substantially the same as those of the conventional apparatus explained with reference to FIG. 9.

The characteristic configuration of the ion attachment mass spectrometry apparatus having the above basic configuration will be explained next. In the ion attachment mass spectrometry apparatus according to the present embodiment, a third component gas introduction mechanism 51 configured to introduce into the ionization chamber 11 one type of third component gas among a plurality of types, for example, three types, of third component gases (A, B, and C), is provided. The third component gas introduction mechanism 51 is provided with three third component gas cylinders 52*a*, 52*b*, and 52*c* and valves 53*a*, 53*b*, and 53*c* provided at the gas introduction pipes of the third component gas cylinders. The third component gas cylinders 52*a*, 52*b*, and 52*c* contain different types of third component gases A, B, and C, respectively. The opening and closing operations of the valves 53*a*, 53*b*, and 53*c* for introducing the third component gases A, B, and C into the ionization chamber 11 or stopping the introduction are automatically controlled by the data processor 50. The valves 53*a*, 53*b*, and 53*c* are opened or closed at suitable timings in accordance with the measurement conditions. Due to this, one type of third component gas among the three types of the above-mentioned third component gases is suitably selected and introduced into the ionization chamber 11.

As explained above, the ion attachment mass spectrometry apparatus according to the present embodiment is exactly the same in its basic configuration and operation as the conventional apparatus explained with reference to FIG. 9. As the characteristic section the apparatus has the third component gas introduction mechanism 51 configured to enable selective introduction of suitable one type of third component gas among the three types of third component gases. In the ion attachment mass spectrometry apparatus of the present embodiment, one third component gas is suitably selected and used from a plurality of types prepared in advance, for example, the three types of third component gases A, B, and C, in response to the type of the gas to be detected or the purpose of measurement, in particular when measuring a low concentration gas, to prevent the occurrence of a state where signal measurement is not possible due to interference against the gas to be detected. In this configuration of the embodiment, for example, three third component gas cylinders 52*a*, 52*b*, and 52*c* are provided in the apparatus. By opening one among the three valves 53*a*, 53*b*, and 53*c*, only one type of third component gas is introduced into the ionization chamber 11 for causing an ion attachment reaction.

Further, when the interference occurs even if the third component gas is changed or when it is unknown whether the interference occurs, the opening or closing operations of the valves 53*a*, 53*b*, and 53*c* in the third component gas introduction mechanism 51 are controlled by the data processor 50 to successively introduce different third component gases into the ionization chamber 11, due to this, a plurality of measurements are performed using the different third component gases, and the interference peak arising due to the third component gas is identified based on the set of measurement data.

Next, specific examples of the method of analysis using the above ion attachment mass spectrometry apparatus will be explained in detail for different cases with reference to the drawings.

Figure 2:
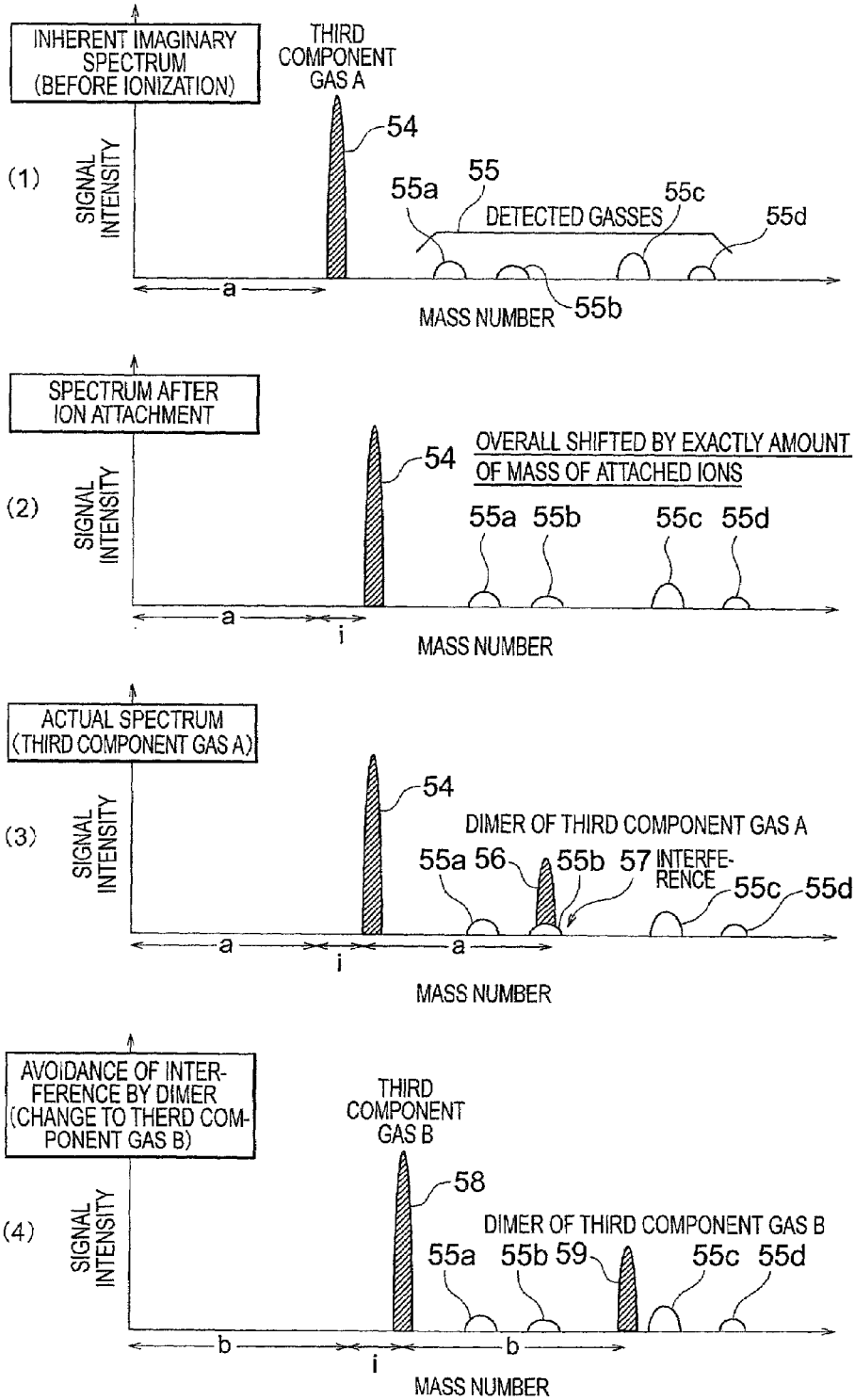
FIG. 2 is a view for explaining the interference due to a macromer of third component gases and the prevention of the interference.

FIG. 2 shows an example of the case where a dimer of third component gases is generated and the interference peak thereby is caused. In this method of analysis using the above ion attachment mass spectrometry apparatus, it is possible to eliminate the interference peak due to the dimer of the third component gases.

In FIG. 2, (1) shows an imaginary spectrum due to the gas to be detected and the third component gas A present in the ionization chamber or the reaction chamber, (2) shows the spectrum after ion attachment, (3) shows the actual spectrum (using the third component gas A), and (4) shows avoidance of interference due to the dimer (the third component gas B is used). In the graphs showing the spectra, the abscissas show the mass number and the ordinates the signal intensity. Further, the above "imaginary spectrum" means the inherent spectrum of the gas before ionization. A gas cannot be measured unless ionized, so this spectrum is imaginary. If the mass number of the third component gas A is "a", a peak 54 of the third component gas A appears at the position of "a" on the abscissa. If the third component gas A is $N_2$, for example, the mass number "a" on the abscissa becomes 28. Further, reference numeral 55 shows the region where the spectrum of the detected gas is distributed and includes the peaks 55*a*, 55*b*, 55*c*, and 55*d* of the detected gas.

The spectrum after attachment of metal ions for actual measurement becomes as shown in FIG. 2(2). All of the peaks 54 and 55*a* to 55*d* shown in FIG. 2(2) are shifted to the high mass side (right side in the figure) by exactly the mass number (=i) of the metal ions attached. That is, the mass number on the abscissa of the peak 54 due to the third component gas A in FIG. 2(2) becomes a+i. For example, if the third component gas A is $N_2$ and the metal ions are Li, the mass number becomes 28+7=35. If assuming no macromer occurs, no interference arises in this state so long as there is no detected gas of the same type as the third component gas A from the start.

In accordance with the method of ion attachment mass spectrometry, however, a macromer is actually formed in the process of ionization. The case where the third component gas A forms a dimer is shown in FIG. 2(3). Reference numeral 56 shows the peak of the dimer. If the position of appearance of the peak is indicated by the mass number, it becomes 2a+i. If there is a detected gas present right at the same position, an interference state (state of 57 in the figure, called "interference peak") is caused. In general, the third component gas is relatively hard for metal ions to attach to and becomes a dimer even less frequently, but this becomes a major problem when measuring a low concentration gas to be detected.

Therefore, in the ion attachment mass spectrometry apparatus shown in FIG. 1, under the control function of the data processor 50, the valve 53*a* which had first been opened is closed to stop the introduction of the third component gas A into the ionization chamber 11, then the valve 53*b* is opened to introduce the third component gas B into the ionization chamber 11. In this way, to eliminate the occurrence of an interference peak, the type of the third component gas is changed from A to B and a third component gas B with a mass number "b" is used. By doing this, as shown in FIG. 2(4), the position of appearance of the peak 59 due to the dimer becomes the position of the mass number 2b+i as compared with the peak 58 of the ion attached third component gas B and no longer interferes with the peak 55*b* of the detected gas.

The type of the third component gas introduced into the ionization chamber 11 is usually selected in accordance with a predetermined routine when judging the interference has occurred by the data processor 50 for judging the measurement results obtained.

Figure 3:
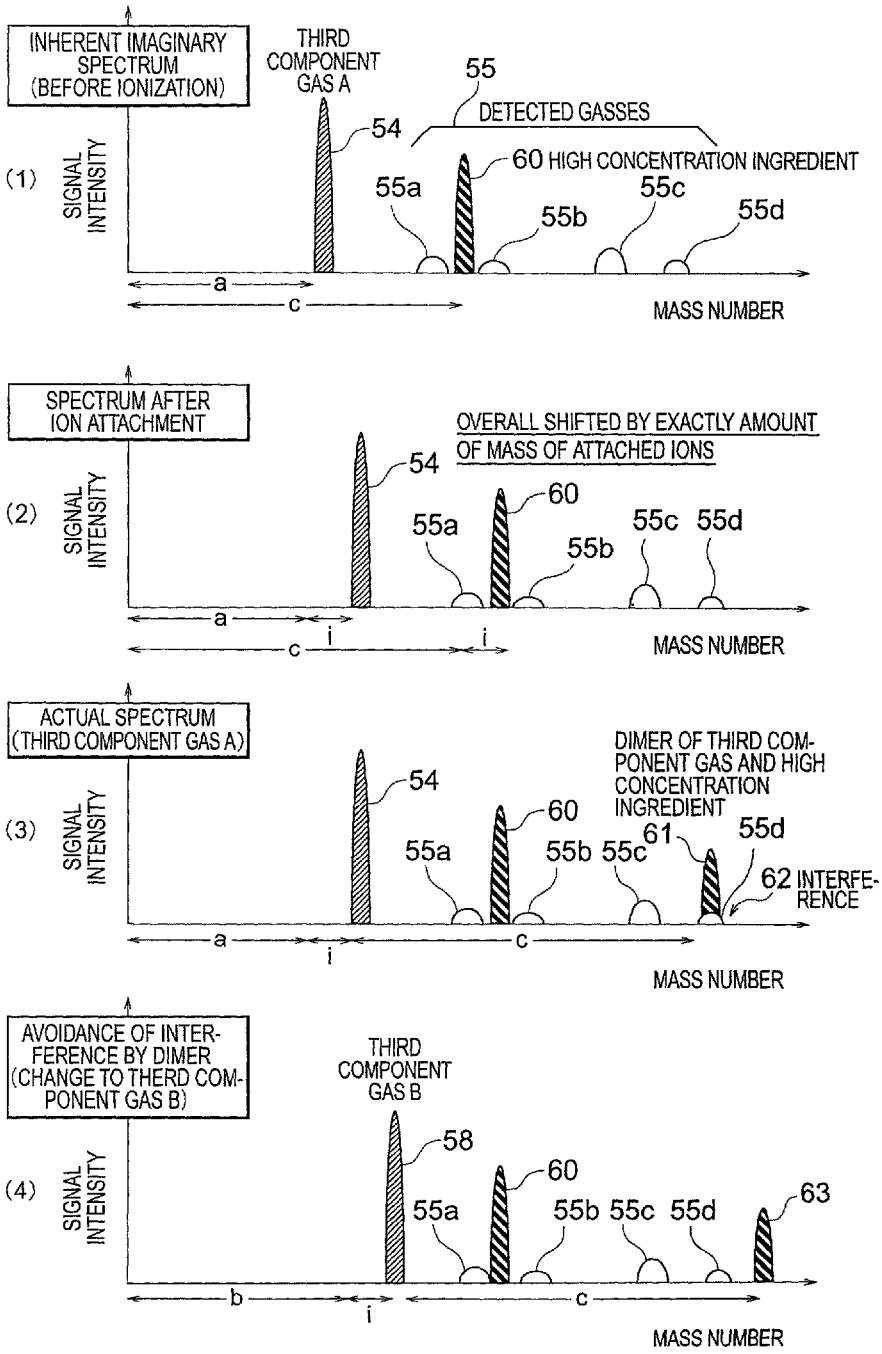
FIG. 3 is a view for explaining the interference due to a macromer of the third component gas and the high concentration ingredient and prevention of the interference.

FIG. 3 shows the case where the dimer of the third component gas and the high concentration ingredient is generated and an interference peak is generated. With the method of analysis using the above ion attachment mass spectrometry apparatus, it is possible to eliminate the interference peak due to the dimer of the third component gas and high concentration ingredient.

FIG. 3 substantially corresponds to FIG. 2. (1) to (4) of FIG. 3 correspond to (1) to (4) of FIG. 2. In (1) to (4) of FIG. 3, the abscissas indicate the mass number and the ordinates the signal intensity. In FIG. 3, the elements explained in FIG. 2 are given the same reference numerals and the previous explanation should be referred to. Here, a detailed explanation will be omitted. In this example as well, first, the third component gas A is used. FIG. 3(1) shows the distribution of an inherent imaginary spectrum in the case of the presence of a peak 60 due to a high concentration ingredient of a mass number "c" in the region 55 where the peak 54 due to the third component gas A and the peaks 55*a* to 55*d* of the detected gas occur. FIG. 3(2) shows the distribution of the spectrum after ion attachment in the case where there is no macromer, while FIG. 3(3) shows the distribution of an actual spectrum with the dimer of the third component gas and the high concentration ingredient. The peak 61 of this dimer appears at the position of the mass number a+i+c. At this time, if there is a peak 55*d* of the low concentration detected gas right at the same position, the result is an interference peak as shown in the state 62. Therefore, as shown in FIG. 3(4), if the third component gas used is changed from the above third component gas A to the third component gas B (shown by the peak 58) with the mass number "b", the position of appearance of the peak 63 due to the dimer becomes a+i+c and there is no longer interference with the peak 55*d* of the detected gas.

The change from the type A to B of the third component gas for avoiding the above interference 62 is, in the same way as the above, executed based on the control function of the data processor 50 in the ion attachment mass spectrometry apparatus shown in FIG. 1.

Figure 4:
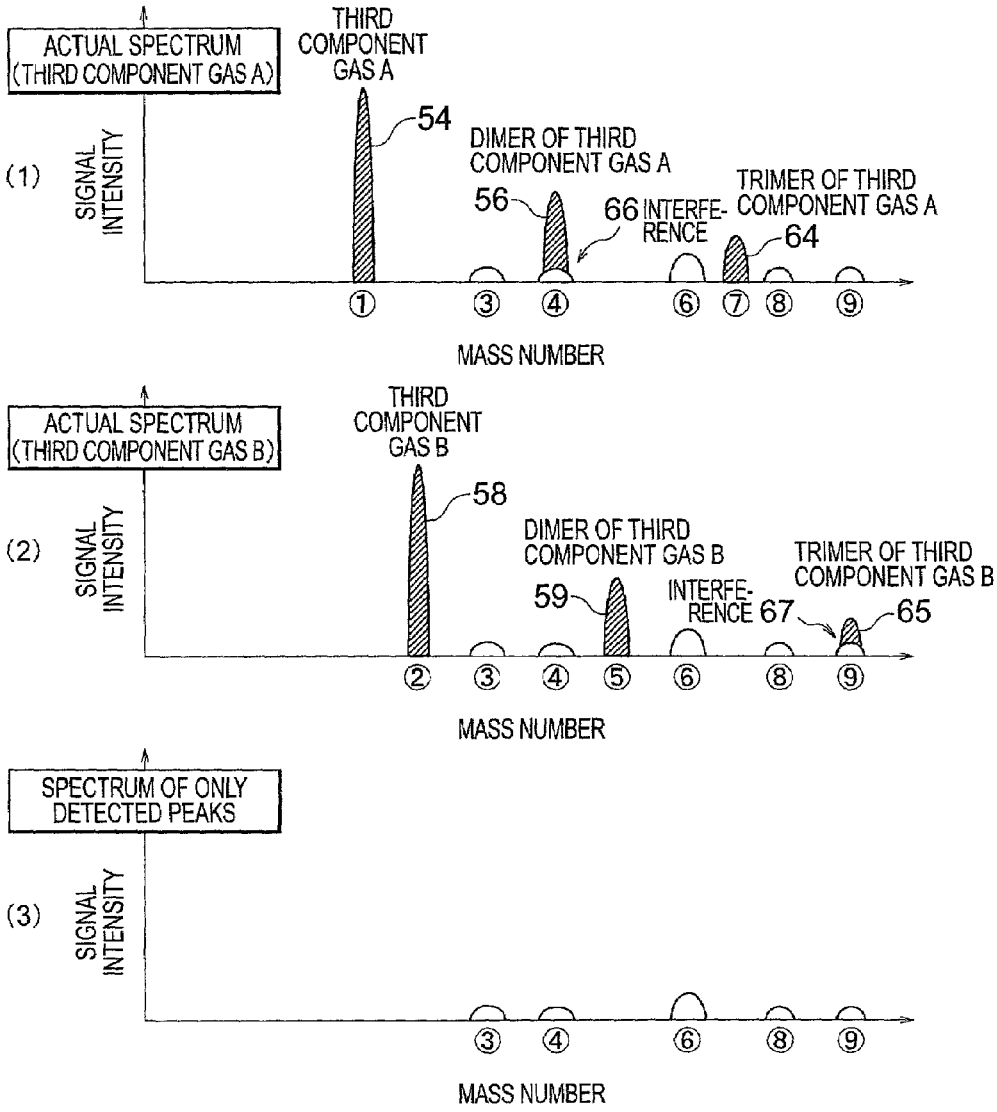
FIG. 4 is a view explaining the derivation of the spectrum of just the detected peaks (the macromers of the third component gases)

FIG. 4 shows an example of the case of occurrence of interference and appearance of an interference peak in both the case of a dimer and a trimer of the third component gases. In the method of analysis using the above ion attachment mass spectrometry apparatus, it is possible to eliminate the interference peaks due to a dimer and a trimer of a third component gas. The explanation will be made about the means for deriving the spectrum of only the peaks of the detected gas when there is interference with both the dimer and the trimer of the third component gases.

FIG. 4 substantially corresponds to FIG. 2. In (1) to (3) of FIG. 4, the abscissas indicate the mass number, while the ordinates indicate the signal intensity. In FIG. 4, the elements explained in FIG. 2 are assigned the same reference numerals and the previous explanations should be referred to. In the above-mentioned ion attachment mass spectrometry apparatus, first the mass spectrometry is performed using the third component gas A, then mass spectrometry is performed using the third component gas B. FIG. 4(1) shows the actual spectrum resulting from the third component gas A, while FIG. 4(2) shows the actual spectrum resulting from the third component gas B. As shown in (1) and (2) of FIG. 4, with each of the third component gases A and B, in addition to their own peaks 54 and 58, not only the peaks 56 and 59 of dimers, but also the peaks 64 and 65 of trimers occur. In FIG. 4(1), the portion of the peak 56 of the dimer of the third component gas A forms an interference peak, while in FIG. 4(2), the portion of the peak 65 of the trimer of the third component gas B becomes an interference peak. Further, the sensitivity of the peaks of the detected gas changes depending on the type of the third component gas, so in FIG. 4(2), the peaks of the detected gas (shown at positions indicated by ③, ④, ⑥, ⑧, and ⑨) become smaller as a whole. In (1) and (2) of FIG. 4, the reference numerals ① to ⑨ are shown on the abscissas corresponding to the locations of occurrence of the peaks.

In the ion attachment mass spectrometry apparatus according to the present embodiment, the spectrum of only the peaks of the detected gas are derived as follows from the two spectra measured as shown in (1) and (2) of FIG. 4.

First, a peak where no interference occurs is selected from the spectrum of FIG. 4(1). The positions of appearance of the dimer and trimer are known from the molecular weight of the third component gas A, so while the magnitudes are unclear, it is possible to determine the peaks where the interferences 66 and 67 occur. Therefore, it is possible to determine that ③, ⑥, ⑧, and ⑨ of FIG. 4(1) are peaks where interference does not occur. In FIG. 4(2) as well, similarly ③, ④, ⑥, and ⑧ are determined as peaks where interference does not occur, so the peaks where interference does not occur in both are ③, ⑥, and ⑧. Comparing the magnitudes of the peaks of ③, ⑥, and ⑧ of FIG. 4(1) and 4(2), the difference in sensitivity depending on the third component gases A and B is determined. Therefore, if using the peaks of FIG. 4(2) for ③, ④, ⑥, and ⑧ and using the peak of ⑨ of FIG. 4(1) calibrated by the difference of sensitivity for ⑨, it is possible to derive the peaks of all of the detected gas as shown in FIG. 4(3).

Figure 5:
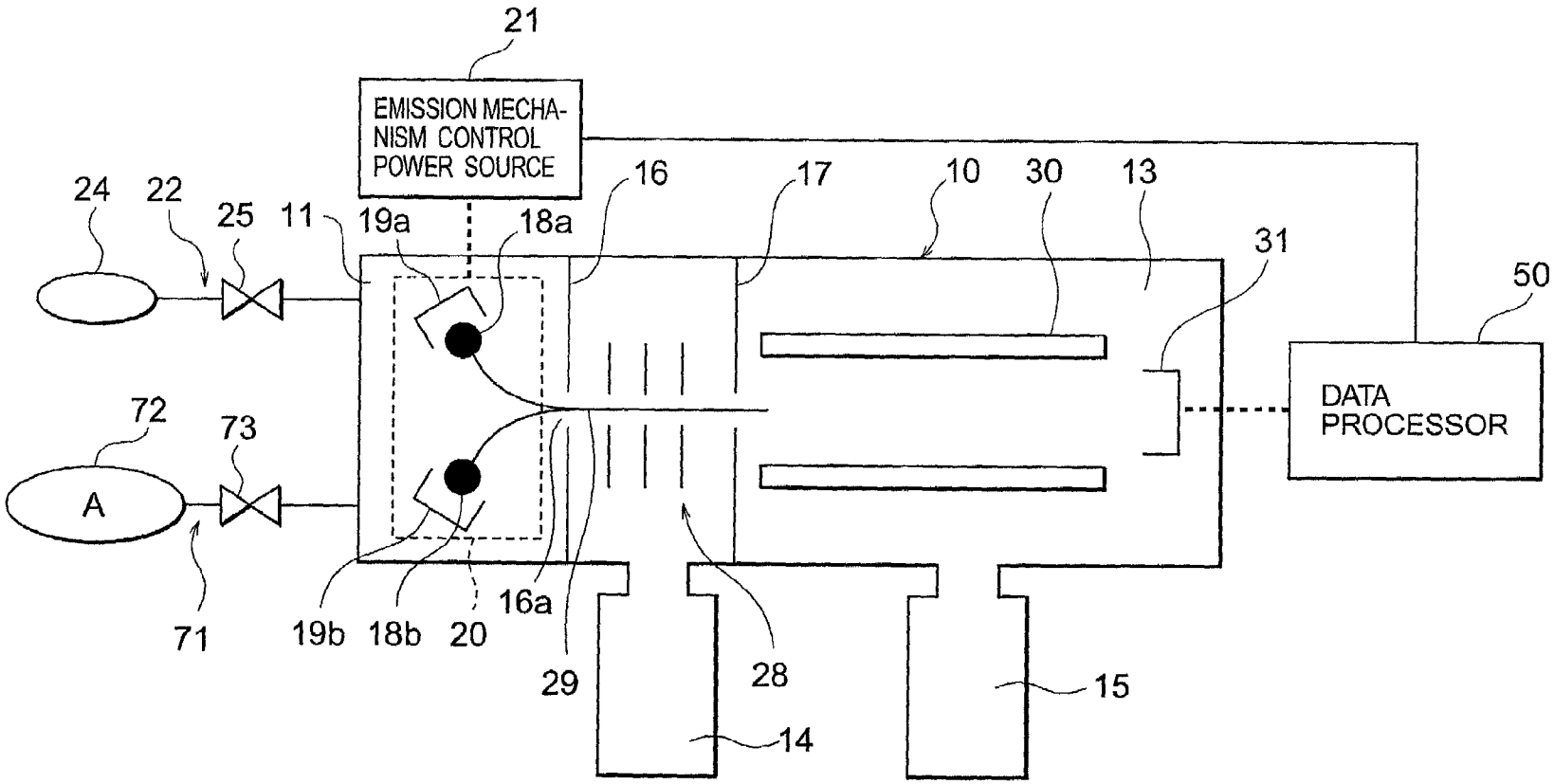
FIG. 5 is a view of the configuration of another embodiment of the ion attachment mass spectrometry apparatus according to the present invention.

Next, another embodiment of the method and apparatus for ion attachment mass spectrometry according to the present invention will be explained with reference to FIG. 5. In FIG. 5, elements substantially the same as the elements explained in the above embodiment are assigned the same reference numerals and detailed explanations will be omitted. In this embodiment, the third component gas introduction mechanism 71 is configured to introduce only one type of third component gas (in this case, the third component gas A) and is provided with a single third component gas cylinder 72 and valve 73. This configuration is the same as the configuration of the conventional apparatus explained with reference to FIG. 9. The characteristic section of this embodiment lies in the emission mechanism 20. The emission mechanism 20 is provided with a plurality of types, for example, two types, of ion emitters 18*a* and 18*b*. Metal ions "f" are emitted from the ion emitter 18*a*, while metal ions "g" are emitted from the ion emitter 18*b*. The ion emitters 18*a* and 18*b* have repellers 19*a* and 19*b* arranged at the rear sides. The emission mechanism 20 including these ion emitters is provided with an emission mechanism control power source 21. The emission mechanism control power source 21 selects one ion emitter from the two types of ion emitters 18*a* and 18*b*, supplies the power to it, and causes the emission of ions. Note that in the case of this embodiment, the data processor 50 has the function of data processing and function of controlling the powering operation of the emission mechanism control power source 21. Due to this, the emission mechanism control power source 21 supplies power to one of the ion emitters in accordance with the situation and necessity.

One ion emitter is suitably selected and used from two types of ion emitters 18*a* and 18*b* prepared in advance according to the type of the gas to be detected or the purpose of measurement, for example when measuring a low concentration gas, to prevent the occurrence of interference with the detected gas. That is, two ion emitters 18*a* and 18*b* are arranged offset from the axis of flow of the ions (line matching with path 29), one of these is heated by being powered from the emission mechanism control power source 21, and thereby only one type of metal ions is emitted. Even metal ions emitted from the ion emitter at a position offset from the axis move riding the flow of the gas, so no problem arises in measurement.

Further, when interference arises even when changing the ion emitter or when whether interference occurs is unclear, the data processor 50 controls the operation so as to switch the ion emitter powered by the emission mechanism control power source 21, make a plurality of measurements by successively different ion emitters, and identify an interference peak arising due to an ion emitter from these data.

Next, specific examples of the method of analysis using the ion attachment mass spectrometry apparatus according to another embodiment will be explained for different cases with reference to the figures.

Figure 6:
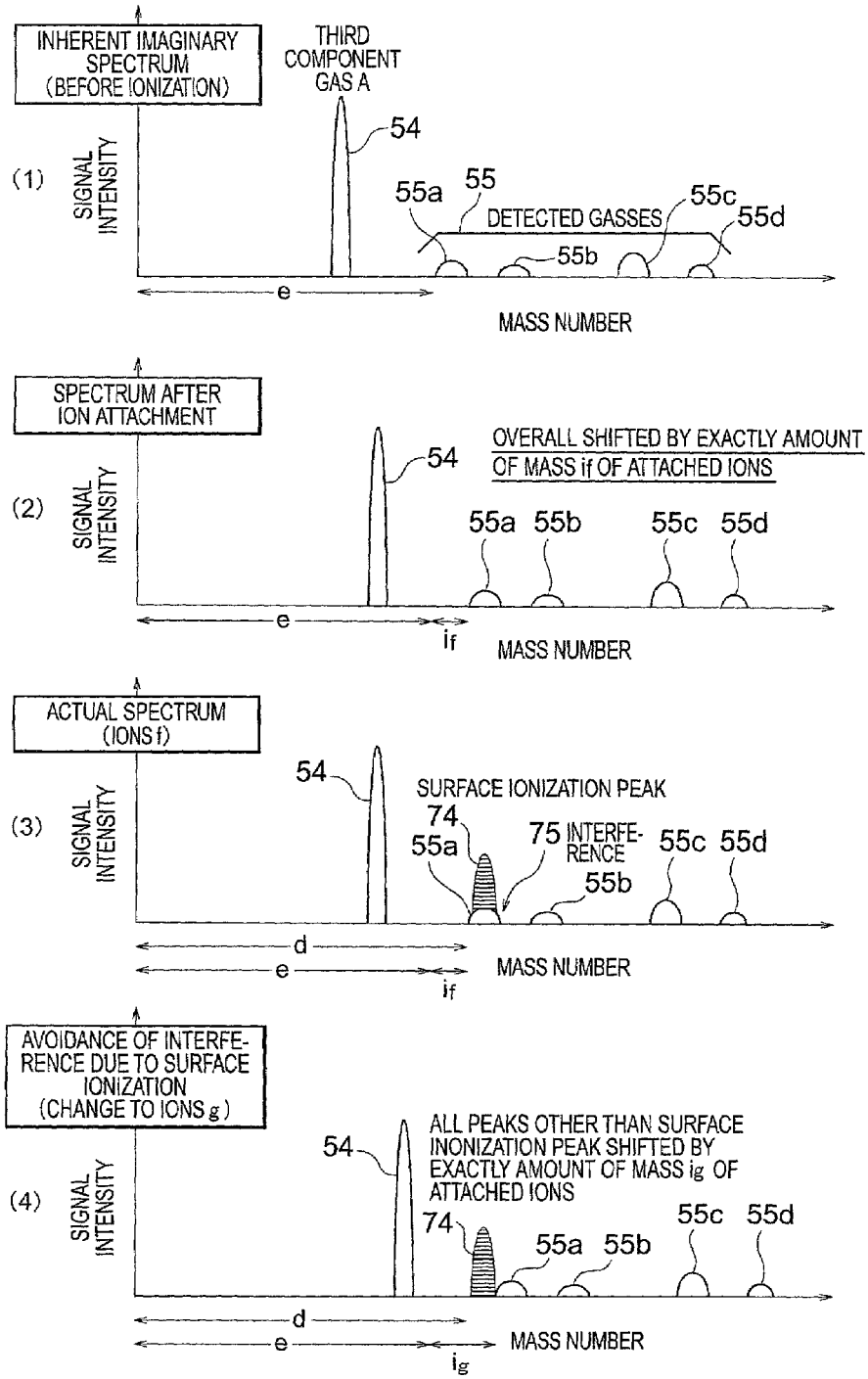
FIG. 6 is a view for explaining the interference due to surface ionization ions and prevention of the interference.

FIG. 6 shows an example of occurrence of an interference peak due to surface ionization ions. With the method of analysis based on the above ion attachment mass spectrometry apparatus, it is possible to eliminate an interference peak due to surface ionization ions. The means for eliminating the interference peak due to the surface ionization ions will be explained next.

FIG. 6 substantially corresponds to FIG. 2. (1) to (4) of FIG. 6 correspond to (1) to (4) of FIG. 2, respectively. In FIG. 6(1) to 6(4), the abscissas indicate the mass number, while the ordinates indicate the signal intensity. In FIG. 6, the elements explained in FIG. 2 are assigned the same reference numerals and the previous explanations should be referred to. FIG. 6(1) shows the distribution of an inherent imaginary spectrum in the case of the presence of a low concentration detected gas 55*a* of a mass number "e" in the detected gas 55. FIG. 6(2) shows the distribution of the spectrum after ion attachment in the case of use of metal ions of the mass number $i_f$ and no surface ionization. The previous detected gas 55*a* appears at the position of the mass number $e+i_f$. FIG. 6(3) shows the distribution of the actual spectrum in the case of surface ionization. The surface ionization peak 74 appears at the position of the mass number "d". Therefore, when $e+i_f=d$, the interference peak 75 appears. Therefore, as shown in FIG. 6(4), if changing to metal ions of the mass number $i_g$, all of the peaks relating to the detected gas except for the surface ionization shift by exactly $i_g$ and interference no longer occurs.

To change the metal ions, the ion attachment mass spectrometry apparatus shown in FIG. 5 performs a selection operation for switching to one of the two ion emitters 18*a* and 18*b*.

Figure 7:
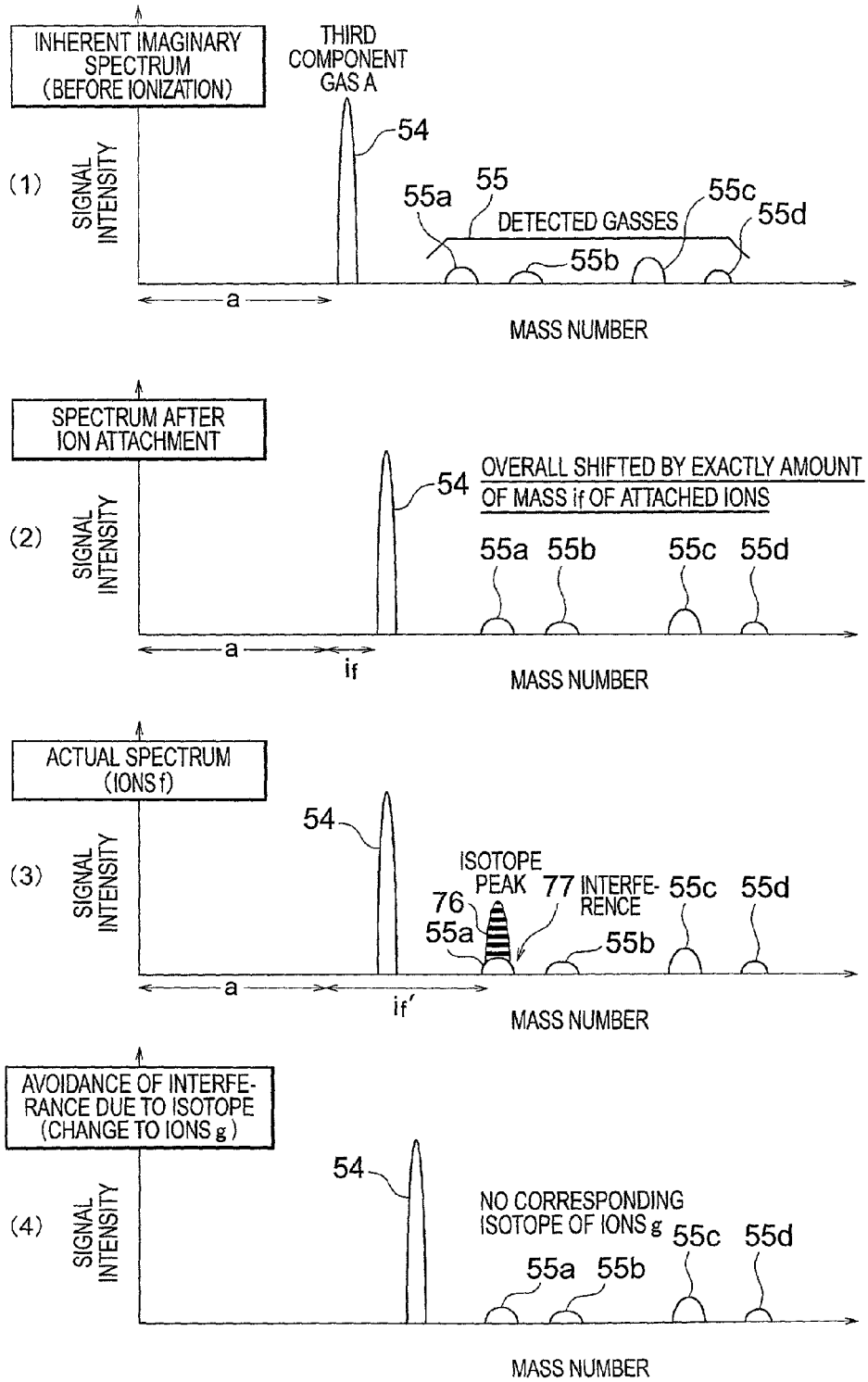
FIG. 7 is a view for explaining the interference due to an isotope of metal ions and prevention of the interference.

FIG. 7 shows an example of the case of occurrence of an interference peak due to an isotope of the metal ions. With this method of analysis using the above ion attachment mass spectrometry apparatus, it is possible to eliminate an interference peak due to an isotope of the metal ions. The means for eliminating an interference peak due to an isotope of the metal ions will be explained next.

FIG. 7 substantially corresponds to FIG. 2. (1) to (4) of FIG. 7 correspond to (1) to (4) of FIG. 2, respectively. In FIG. 7(1) to 7(4), the abscissas indicate the mass number, while the ordinates indicate the signal intensity. In FIG. 7, elements the same as the elements explained in FIG. 2 are assigned the same reference numerals and the above explanations should be referred to. Here, detailed explanations will be omitted. FIG. 7(1) shows the distribution of the inherent imaginary spectrum, while FIG. 7(2) shows the distribution of the spectrum after the attachment of metal ions of the mass number if in the case of no isotope. The third component gas appears at just the position of the mass number $a+i_f$. FIG. 7(3) shows the distribution of the actual spectrum with an isotope of a mass number if. The peak 76 of the third component gas of the isotope also appears at the mass number $a+i_f$. Therefore, if there is a peak 55*a* of a low concentration detected gas at exactly the same position, the interference peak 77 arises. Therefore, as shown in FIG. 7(4), if changing to other metal ions with no isotopes, the isotope peak 76 disappears and, as a result, interference disappears. Note that the metal ions changed to are the same metal ions, but with the isotopes separated and removed.

In the method of analysis for eliminating an interference peak arising due to an isotope of the metal ions, in the ion attachment mass spectrometry apparatus shown in FIG. 5, it is necessary that the metal ions "g" emitted from the ion emitter 18*b* have no isotope.

Figure 8:
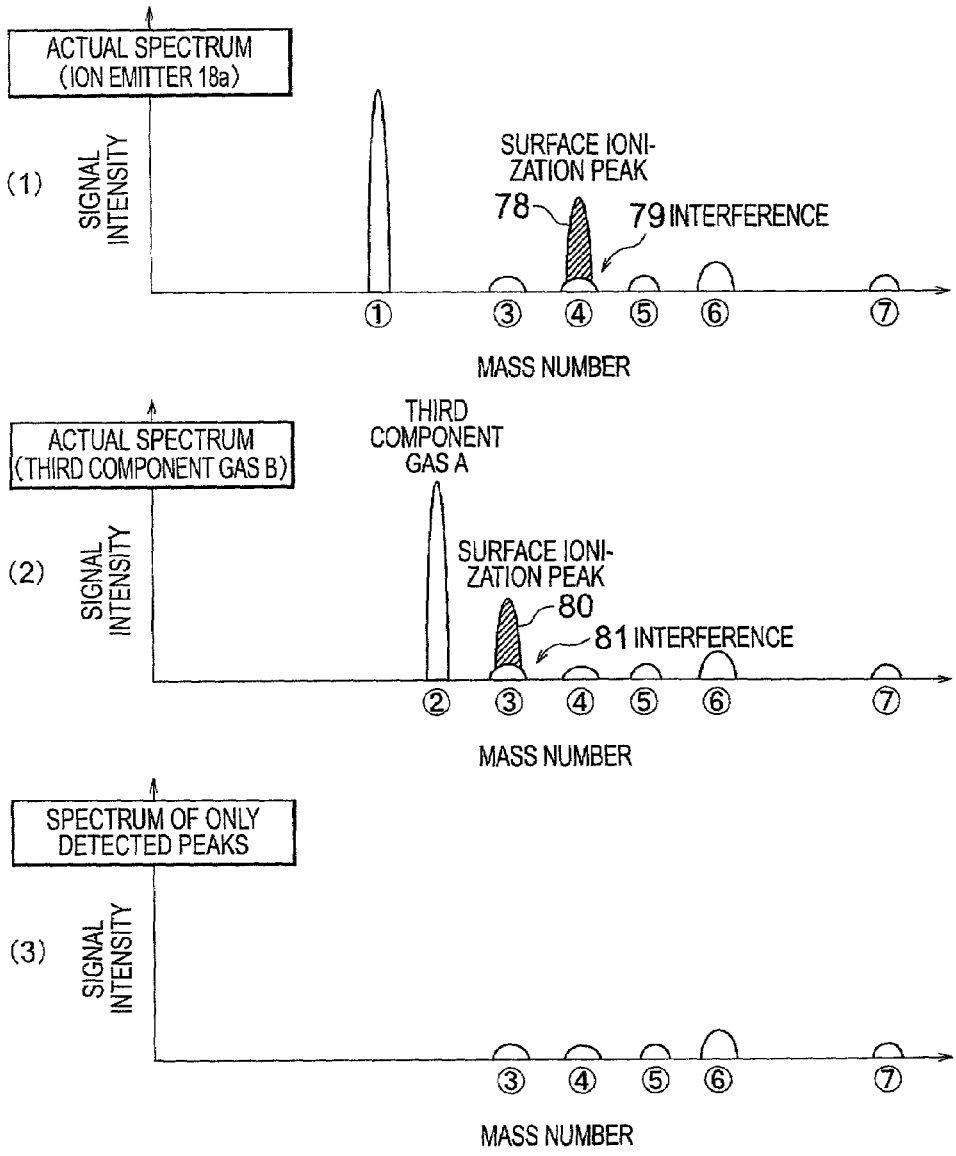
FIG. 8 is a view explaining the derivation of the spectrum of just the detected peaks (the surface ionization peak)

FIG. 8 shows an example of the case of occurrence of interference and appearance of an interference peak at each of the surface ionization peaks. With the method of analysis using the above ion attachment mass spectrometry apparatus, it is possible to eliminate interference peaks due to surface ionization peaks. The means for deriving the spectrum of only the peaks of the detected gas when interference occurs due to surface ionization peaks with each of the ion emitters will be explained next.

FIG. 8 substantially corresponds to FIG. 2 and FIG. 4. In FIG. 8(1) to 8(3), the abscissas indicate the mass number, while the ordinate indicates the signal intensity. In FIG. 8, elements explained with reference to FIG. 2 and FIG. 4 are assigned the same reference numerals and the above explanations should be referred to. FIG. 8(1) shows the actual spectrum due to the ion emitter 18*a* using the third component gas A, while FIG. 8(2) shows the actual spectrum due to the ion emitter 18*b* using the third component gas B. In FIG. 8(1), interference 79 due to the surface ionization peak 78 occurs at the peak of the detected gas shown by reference numeral ④. As opposed to this, in FIG. 8(2), interference 81 occurs at the surface ionization peak 80 of another detected gas (corresponding to reference numeral ③). Further, the sensitivity of the peaks of the detected gas changes due to the type of the third component gas.

The spectrum of only the peaks of the detected gas is derived as explained below based on the two spectra measured shown in FIGS. 8(1) and 8(2). Different from the case of a macromer, it is unclear where the surface ionization peak appears. Therefore, the ratio of the magnitudes of the corresponding peaks at FIGS. 8(1) and 8(2) is calculated. In FIGS. 8(1) and 8(2), the peaks shift by exactly the difference of the molecular weight of the metal ions, so the corresponding peaks can be easily determined. All of the peaks ③ and ④ among ③, ④, ⑤, ⑥, and ⑦ have generally the same ratios, so it is determined that interference occurs at ③ and ④. With surface ionization, the peaks appear at the same locations, so it is judged that ③ shows a detected peak in FIG. 8(1) and ④ a detected peak in FIG. 8(2). In this way, as shown in FIG. 8(3), it is possible to derive the peaks of all of the detected gases.

In the first embodiment, a plurality of third component gas cylinders were prepared, but the invention is not limited to this. It is sufficient that a plurality of types of third component gases can be introduced into the reaction chamber. The method of switching the plurality of types of third component gases may, as mentioned above, be automatic or manual. As the third component gas, nitrogen ($N_2$) or argon (Ar) is used.

In the second embodiment, the ion emitters were arranged at positions offset from the axis, but the invention is not limited to this, For example, they may be arranged changed in position along the axis. Further, heating was used to select the ion emitter used, but the invention is not limited to this. It is sufficient that the plurality of ion emitters can be select to emit the metal ions. For example, it is also possible to change the voltage applied to the repellers.

In the above embodiments, the explanation was made about separate apparatuses for dealing with the interference arising due to the third component gases and interference arising due to ion emitters, but these may also be combined to a single apparatus.

In the above embodiments, the explanation was given with respect to $Li^+$ as the metal ions, but the invention is not limited to this. It is also possible to use $K^+$, $Na^+$, $Rb^+$, $Cs^+$, $Al^+$, $Ga^+$, $In^+$, etc. As metal ions with no isotope (extremely low presence), Na may be used. Further, as the mass spectrometer, use was made of a Q-pole type mass spectrometer, but the invention is not limited to this. It is also possible to use a three-dimensional (3D) type, magnetic field sector type, time-of-flight (TOF) type, or ion cyclotron resonance (ICR) type mass spectrometer.

Further, in the above embodiments, the explanation was given with reference to samples to be measured all in the gaseous state, but the samples themselves may also be solids or liquids. It is possible to convert solid or liquid samples to a gaseous state by some means or another and then analyze that gas. Further, the apparatus of the present invention may also be connected to another component separation apparatus, for example, a gas chromatograph or liquid chromatograph, for use as a gas chromatograph/mass spectrometer (GC/MS) or liquid chromatograph/mass spectrometer (LC/MS).

While the invention has been described with reference to specific embodiment chosen for purpose of illustration, it should be apparent that numerous modifications could be made thereto by those skilled in the art without departing from the basic concept and scope of the invention.

The present disclosure relates to subject matter contained in Japanese Patent Application No. 2000-401483, filed on Dec. 28, 2000, the disclosure of which is expressly incorporated herein by reference in its entirety.

What is claimed is:

1. A method of ion attachment mass spectrometry for introducing a gas to be detected and an excess-energy absorbing gas into an ionization chamber in which an ion emitter for emitting positively charged metal ions is arranged, and attaching said metal ions to said gas to be detected in said ionization chamber in an atmosphere of said excess-energy absorbing gas so as to ionize the gas to be detected by the metal ions, then performing measurement of mass of the gas by mass spectrometry, comprising a step of preparing in advance a plurality of types of excess-energy absorbing gas, whose mass numbers are mutually different, in the outside of said ionization chamber, a step of performing the measurement by selecting one type of excess-energy absorbing gas from said plurality of types of excess-energy absorbing gas, and introducing it into said ionization chamber, a step of judging whether interference peaks are generated or not by data of said measurement, and a step of performing the measurement by selecting another type of excess-energy absorbing gas from said plurality of types of excess-energy absorbing gas, which generates no interference peak, when judging that the interference peaks are generated.

2. A method of ion attachment mass spectrometry for introducing a gas to be detected and an excess-energy absorbing gas into an ionization chamber in which an ion emitter for emitting positively charged metal ions is arranged, and attaching said metal ions to said gas to be detected in said ionization chamber in an atmosphere of said excess-energy absorbing gas so as to ionize the gas to be detected by the metal ions, then performing measurement the mass of the gas by mass spectrometry, comprising a step of preparing in advance a plurality of types of excess-energy absorbing gas, whose mass numbers are mutually different, in the outside of said ionization chamber, a step of individually performing the measurement by selecting said plurality of types of excess-energy absorbing gas one by one, and introducing it into said ionization chamber, a step of distinguishing existence of interference peaks arising due to said plurality of types of excess-energy absorbing gas from the data obtained from these measurements, and a step of performing the measurement on condition that no interference peak is generated.

3. A method of ion attachment mass spectrometry for introducing a gas to be detected and an excess-energy absorbing gas into an ionization chamber in which an ion emitter for emitting positively charged metal ions is arranged, and attaching said metal ions to said gas to be detected in said ionization chamber in an atmosphere of said excess-energy absorbing gas so as to ionize the gas to be detected by the metal ions, then performing measurement the mass of the gas by mass spectrometry, comprising a step of preparing in advance a plurality of types of ion emitters which emit said metal ions having different mass numbers in the inside of said ionization chamber, a step of performing the measurement by selecting one type of ion emitter from said plurality of types of ion emitters, and providing power to said ion emitter, a step of judging whether interference peaks are generated or not by data of said measurement, and a step of performing the measurement by selecting another type of ion emitter from said plurality of types of ion emitters, which generates no interference peak, when judging that the interference peak is generated.

4. A method of ion attachment mass spectrometry for introducing a gas to be detected and an excess-energy absorbing gas into an ionization chamber in which an ion emitter for emitting positively charged metal ions is arranged, and attaching said metal ions to said gas to be detected in said ionization chamber in an atmosphere of said excess-energy absorbing gas so as to ionize the gas to be detected by the metal ions, then performing measurement of mass of the gas by mass spectrometry, comprising a step of preparing in advance a plurality of types of ion emitters, which emit said metal ions having different mass numbers, in the inside of said ionization chamber, a step of individually performing the measurement by selecting said plurality of types of ion emitter one by one, and providing power to said ion emitter, a step of distinguishing existence of interference peaks arising due to said plurality of types of ion emitters from the data obtained from these measurements, and a step of performing the measurement on condition that no interference peak is generated.

5. An apparatus for ion attachment mass spectrometry comprising, an ion emitter for emitting positively charged metal ions, an ionization chamber for attaching the metal ions to a gas to be detected, which is provided with said ion emitter, an excess-energy absorbing gas introduction mechanism provided with a plurality of types of excess-energy absorbing gas whose mass numbers are mutually different and introducing one type of excess-energy absorbing gas selected from the plurality of types of excess-energy absorbing gas into the ionization chamber, a mass spectrometer for performing mass spectrometry to detect the gas to which the metal ions are attached, and a data processor for judging existence of interference peaks in measurement data obtained by detection in said mass spectrometer using said excess-energy absorbing gas to be introduced, wherein said data processor makes said excess-energy absorbing gas introduction mechanism to select another excess-energy absorbing gas with different mass number and introduce it into said ionization chamber in order to perform said measurement, when judging that the interference peaks exist.

6. An apparatus for ion attachment mass spectrometry comprising, an ion emitter for emitting positively charged metal ions, an ionization chamber for attaching the metal ions to a gas to be detected, provided with said ion emitter, an excess-energy absorbing gas introduction mechanism provided with a plurality of types of excess-energy absorbing gas whose mass numbers are mutually different and introducing one type of excess-energy absorbing gas selected from the plurality of types of excess-energy absorbing gas into the ionization chamber, a mass spectrometer for performing mass spectrometry to detect the gas to which the metal ions are attached, and a data processor for processing data given from said mass spectrometer for distinguishing an interference peak arising due to the excess-energy absorbing gas from a plurality of sets of measurement data based on a plurality of different types of excess-energy absorbing gas and making said measurement to be performed on condition that no interference peak is generated.

7. An apparatus for ion attachment mass spectrometry comprising, a plurality of types of ion emitters for respectively emitting different types of positively charged metal ions whose mass numbers are mutually different, one of the plurality of types of ion emitters being selected for emission of the metal ions, an ionization chamber for attaching the metal ions to a gas to be detected, wherein said ion emitters are arranged, and said gas is introduced from the outside, an excess-energy absorbing gas introduction mechanism for introducing an excess-energy absorbing gas into said ionization chamber, a mass spectrometer for performing mass spectrometry to detect the gas to which the metal ions are attached, and a data processor for processing data given from said mass spectrometer and judging existence of interference peaks in measurement data obtained by detection in said mass spectrometer using said ion emitter, wherein said data processor selects another ion emitter emitting another metal ion with different mass number in order to perform said measurement, when judging that the interference peaks exist.

8. An apparatus for ion attachment mass spectrometry comprising, a plurality of types of ion emitters for emitting different types of positively charged metal ions whose mass numbers are mutually different, one of the plurality of types of ion emitters being selected for emission of the metal ions, an ionization chamber for attaching the metal ions to a gas to be detected, being provided with said ion emitters, an excess-energy absorbing gas introduction mechanism for introducing an excess-energy absorbing gas into said ionization chamber, a mass spectrometer for performing mass spectrometry to detect the gas to which the metal ions are attached, and a data processor for processing data given from said mass spectrometer for distinguishing an interference peak arising due to a said ion emitter from a plurality of sets of measurement data based on the different ion emitters and making said measurement to be performed on condition that no interference peak is generated.

9. An apparatus for ion attachment mass spectrometry as set forth in claim 7, wherein said plurality of types of ion emitters are arranged at positions offset from the axis.

10. An apparatus for ion attachment mass spectrometry as set forth in claim 8, wherein said plurality of types of ion emitters are arranged at positions offset from the axis.

* * * * *